United States Patent [19]

Peters et al.

[11] 4,192,991

[45] Mar. 11, 1980

[54] OVEN FOR COOKING MEAT ROASTS

[76] Inventors: Leo Peters, 750 Plymouth Rd. SE., Grand Rapids, Mich. 49506; Richard O. Klemm, 4312 Valley View Rd., Crystal Lake, Ill. 60014

[21] Appl. No.: 894,407

[22] Filed: Apr. 7, 1978

[51] Int. Cl.[2] ..... A21B 1/00

[52] U.S. Cl. ..... 219/413; 219/386; 219/396; 219/400; 219/403

[58] Field of Search ..... 219/392, 393, 394, 395, 219/400, 403, 404, 405, 408, 411, 412, 413, 398

[56] References Cited

U.S. PATENT DOCUMENTS

| | | | |
|---|---|---|---|
| 2,273,734 | 2/1942 | Pearce | 219/412 |
| 2,314,592 | 3/1943 | McCormick | 219/412 |
| 2,445,021 | 7/1948 | Clark | 219/413 |
| 2,845,517 | 7/1958 | Dadson | 219/413 |
| 2,922,018 | 1/1960 | Walkoe | 219/393 |
| 3,093,722 | 6/1963 | Schauer, Jr. | 219/398 |
| 3,358,122 | 12/1967 | Torrey | 219/412 |
| 3,604,896 | 8/1968 | Anderson | 219/412 |
| 3,760,155 | 9/1973 | Polansky | 219/412 |

*Primary Examiner*—Bruce A. Reynolds
*Assistant Examiner*—Bernard Roskoski

[57] ABSTRACT

An oven with a fixed-elevation single-shelf for uniformly cooking three or more meat roasts to substantially equal, even, and uniform levels of doneness, centering them within an average 10° F. parameter temperature zone under 212°. Apparatus and procedures subject all of the roasts to substantially equal, even, uniform, and low density heat from naturally ambient (non-mechanically-induced movement) air.

5 Claims, 10 Drawing Figures

OVEN FOR COOKING MEAT ROASTS

DEFINITIONS AND LIMITATIONS

This invention is concerned solely with an oven for cooking meat roasts; an oven being defined as a closed heated cavity or compartment. More particularly, it is limited to ovens that cook with gas-fired or electric dry radiant heat using a thermostat-regulated heat-cycling range calibrated to maintain cooking temperatures under 212° F.

For purposes of illustration only, this invention will use as its exemplary meat item "prime ribs of beef", more accurately called a beef rib, either bone-in or boneless. This item is chosen as the exemplary item because it is the most difficult of all meat roasts for a chef to cook with consistent uniformity to the satisfaction of the consumer. It will be understood, however, that the invention applies to the roasting of all kinds and cuts of meat, especially beef that is to be roasted to any one of the four levels of doneness known as rare, medium-rare, medium, and medium-well.

The term "multiple number", as it applies to the number of meat roasts within an oven, means three or more. All temperatures used herein are based on the Farenheit scale.

BACKGROUND

The background and a partial understanding of the problem for which this invention provides a solution is given in the U.S. patents of Leo Peters: U.S. Pat. Nos. 3,804,965; 3,876,812; and 3,962,961. As such, the present invention is an important extension of, and an adjunct to, said inventions. It concerns a problem about which the oven and restaurant industries have been only vaguely aware. They both knew a problem was present, but there is no evidence to indicate they knew the precise causes of the problem. And not knowing these causes, they were never able to solve the problems.

Stated concisely and simply, the problem, and thus the overall objective of this invention, is to provide interior oven structures, components, methods, and means that, with a built-in fixed combination, will by themselves produce the result described in the foregoing Abstract; namely: "uniformly cooking three or more meat roasts to substantially equal, even, and uniform levels of doneness centered within a 10° F. temperature parameter." No oven in the prior art has been thus built to produce this result.

The existence of this problem is as old as the oven industry. In view of this age the surprisingly nature of this invention is not that a solution has now been provided, but rather that there is no evidence to indicate that either the restaurant or the oven industries knew the nature or the causes of the problem. It is even more surprising when one considers that the basic causes producing the problem should have been obvious to anyone giving consideration to the basic well-known, and therefore simple, physical laws governing the causes. Since knowledge of these elementary laws is available to all in any standard physics book, and their effects should have been obvious to anyone, the surprising essence of this invention must then reside in both the recognition of the problem and the non-obviousness and the simplicity of the solution.

The situation that triggered the inventors' research on this problem is that described in said prior art inventions of Leo Peters. These inventions were developed, and their problems successfully solved, by concentration on the packaging, transportation, and cooking of single beef roasts. These inventions solved the problems for one or two roasts cooked in conventional prior art ovens. But a successful commercial application of these inventions quickly escalated the number of roasts and resulted in a need for cooking three or more roasts in a single oven cavity.

Larger food-serving establishments such as hotels, restaurants, and institutions require a multiple number of beef roasts to be cooked at one time. With this need, an entirely new set and series of problems made their appearance to obstruct the overall objective stated above. The increase in problems arose from the simple increase in the number of beef roasts in an oven to three or more. This simple increase in number had an immediate, direct, and extended effect on the application of the physical laws governing the distribution of heat in an oven and thus, in turn, on the finished results of cooked beef roasts.

When a single meat roast is cooked in an oven, the roast itself is one of the factors that influences the finished result. Its particular characteristics as defined by its shape, weight, density, thickness, length, composition, and distribution ratio between protein, fat, and bone, all have a bearing on the methods and means required to produce a desired finished result.

Despite a lack of uniformity among a multiple number of meat roasts within a single oven, the oven is expected to produce uniform finished results. It is expected to do this by regulating and manipulating the level, distribution, evenness, velocity, intensity, stratification, cycling time, and duration of the heat within an oven.

The theories and practices embodied in the prior art ovens relating to this regulation and manipulation are many and diverse. Some ovens conform to proven laws of physics; others do not. Some are beneficial to the finished results; others are actually harmful. Many oven structures, thermostats, thermometers, timers, rheostats, heating elements, etc., have been devised for regulating and manipulating oven heat. Yet, under the prior art, the desired finished results have not satisfied the practitioners in the meat roasting industry.

The most outstanding failure of the oven industry to perform up to the satisfaction of the roasting practitioners has been with beef roasts where the levels of doneness are described by such terms as: rare, medium-rare, medium, medium-well, and well-done. Separating each of these levels is a temperature variant of only 5° internal meat heat. Thus, for a beef roast to be rare, the accepted USDA internal temperature levels should be 140° F. for rare; 145° for medium-rare; 150° for medium; 155° for medium-well; and 160° or more for well done. This invention is concerned mainly with the first four levels of doneness because their temperature parameters are so critically narrow. The well-done level can be accomplished quite easily over a wide range of temperatures from 160° to 212°.

In the prior art these levels of doneness were acceptable to the beef roasting industry if only the center of such roasts were done to these levels. The idea of having such levels of doneness throughout the entire body of a roast, from skin to skin, generally appeared to be an unrealizable level of perfection. Sporadic attempts were made to understand and conquer the problems. Many of these attempts were ill-conceived and/or executed.

There is no evidence in the art to indicate that any of the attempts were approached with a studious regard for the many factors that influence a fine finished result. All of them produced results considerably below the overall objective of this invention.

The failures of past attempts produced a fatalistic attitude of mind among the practitioners of beef roasting as regards the achievability of an ideal level, evenness, and equality of doneness, especially with the most popular beef roast: prime ribs. This fatalistic attitude becomes understandable when one becomes aware of the astonishing lack of knowledge in the oven industry about the interior heat factors required to produce the desired level, evenness, and equality of doneness.

During the past several decades the demand from the commercial practitioners of prime rib roasting for methods and means to improve the doneness results for prime ribs has been ever-present, insistent and increasing. For purposes of illustration, therefore, we will use this most difficult of all beef roasts, a prime rib of beef, as the exemplary item with which to describe the methods and means of this invention, with the understanding that they apply to other meat roasts for which a specific level of close-temperatured doneness is desired.

NATURE OF THE PROBLEM

The overall problem involves seven basic individual, specific problems. This large number of specific problems is open evidence of the initial apparent complexity of the overall problem. Since the solution of each problem is a prerequisite for the solution of the whole problem, each problem-solution is therefore a cooperating and contributing factor to a combination that produces the whole solution. Therefore, we will consider each as an individual problem-factor that must be considered both individually and for the effect each has on the other six because each is part of an overall cooperating combination of factors that provide the commercial solution to the overall problem. Each individual problem must be solved in order to solve the overall problem for the preferred embodiment of this invention. Because of their inter-relationship and inter-dependency we call these seven problems: problem-factors. They are set forth in outline form as follows:

1. The problem-factor of three or more beef roasts in a single-cavity oven; a problem of equal exposure to cooking heat.
2. The problem-factor of the narrow levels of meat doneness.
3. The problem-factor of the uniformity and extent of the levels of doneness.
4. The problem-factor of heat stratification, or vertical distribution.
5. The problem-factor of horizontal heat distribution.
6. The problem-factor of heat-input density.
7. The problem-factor of commercial practicability.

1. The Problem Factor of Three or More Beef Roasts In A Single Oven Cavity Is a Problem of Providing Equality of Heat Treatment For Each One of a Multiple Number of Meat Roasts.

When a single beef roast is cooked in an oven all of the several temperature factors, such as heat level, heat movement, heat distribution, heat stratification, heat density, etc., at work within an oven are concentrated on just this one object, the single roast.

In an oven operating with natural ambient heated air, all sides of a single roast receive substantially the same exposure to all of the several heat factors at work in a single-cavity cooking oven. It is quite simple and easy, especially with the inventions described in the above-identified Peters patents, to distribute this exposure equally and uniformly across all the surfaces of a single cooking roast. The individual heat factors are not required to divide their influence and effect among several roasts. It is also quite simple and easy with two beef roasts in a single oven cavity because all isdes of each and both roasts can be given the same even, equal and uniform heat exposure.

An oven built for home use is required to function for only one or two beef roasts cooking at the same time. It is structured for this purpose only, and it fulfills this purpose quite well. Even those sides of two roasts that lie alongside each other can be sufficiently separated from each other so that the ambient oven heat can affect each of said sides alike.

However, when three or more roasts are cooked within a single oven cavity the third roast, lying between the other two on a single shelf, interjects a new factor between the other two. The temperature, shape, and physical blockage of this third roast becomes a barrier to the commonality of the cooking influences that otherwise exist between only two roasts. The same kind of third party influence, in even greater degree, is exerted when three or more roasts are tiered on shelves over each other in a single oven cavity. Actually the tiering adds a fourth-party influence and renders real equality in the finished roasts a practical impossibility.

Thus, the objective of equality in a multiple number of finished roasts becomes also an a priori factor influencing the finished results themselves. Each of the multiple number (three or more) both singly and collectively have a bearing on, and are important factors, influencing the final finished quality of all. The size, shape, and positions in the oven of each roast will have a direct influence on the results of each and all of the other roasts. To the extent that the number is increased, the number of factors influencing the final result is correspondingly increased. Thus, too, the factors that must be considered by any methods and means that are devised to produce the final objective become superficially correspondingly complex.

Since this invention is concerned only with an oven that will cook three or more meat roasts at one time, it is per se concerned with an oven that is to be used by such food preparation establishments as hotels, restaurants, and institutions; to be used in kitchens that cook for large numbers of people. It is common knowledge within this segment of the food industry that the cooking of a multiple number of beef roasts in a single oven cavity and repeatedly producing a consistently equal level and extent of doneness for all the roasts, and do so within any one of the delicate levels of doneness described as rare, medium-rare, medium, and medium-well; and do so from end-to-end and from edge-to-edge within each individual roast, has been impossible under the prior state of the art. Neither the prior art oven manufacturers nor the finest chefs who have presided over the cooking of such beef roasts have been able to devise commercially-acceptable methods and means to accomplish this level of commercial perfection.

It is therefore an objective of this invention to cook three or more beef roasts within a single oven cavity so that each individual roast will be finished at substantially the same level (rare, medium-rare, medium, or medium-well) and the same evenness of doneness from skin-to-skin as every other meat roast in the same oven cavity. Stated another way, the objective is to provide each and every one of a multiple number of roasts in an oven with substantially equal heat treatment.

2. The Problem-Factor of the Levels of Meat Doneness

There are actually five levels of doneness that five different groups of consumers may desire in a beef roast. They are: rare, medium-rare, medium, medium-well, and well-done. The level of "well-done", however, does not require the extraordinary care and tightness of control that is required with the other four levels. Once a beef roast has reached an internal heat throughout of 160°, it is considered "well-done" and it can keep climbing another 52° on up to 212° before a sufficient change will take place in its doneness to make it less acceptable to well-done "prime rib" consumers. Thus, cooking beef roasts to the level of "well-done" is not a highly critical or difficult operation. But cooking beef roasts to the other four levels of doneness throughout each roast has been indeed critical and difficult, and in the prior art has not been acceptably accomplished with three or more meat roasts in one oven cavity.

It is these four levels of rare, medium-rare, medium, and medium-well doneness that create the following three sub-problem-factors under the general heading of "levels of meat doneness."

A. The critical narrowness of the four levels.

These levels are critically important to the consumers who want their beef roasted to these four levels of doneness. It is the only meat roast for which there are distinct and adamant different consumer preferences for and/or against each of these four levels. With no other meat roasts, such as veal, pork, lamb, and poultry, do such preferences and difficulties exist because all of these call for "well-done."

The strong consumer preferences for four distinct levels of doneness with their four distinct differences in meat color, texture, juiciness, and flavor, make beef roasts, especially beef roasts known as "prime ribs of beef," a uniquely special and highly critical problem for those in the field of meat cookery. It is a special and unique problem because no other meat roasts require these different levels of doneness.

It is a critical problem because the four levels of doneness require, and are controlled by, three different very narrow 5°± (total 10° range) parameter-confined levels of temperature. The USDA-approved ideal internal meat temperature to produce a rare level of doneness is 140°; for medium rare, 145°; for medium, 150°; and for medium-well, 155°. a 5° finished variance over or under these temperatures will change the finished roast from one of the levels of doneness to another level. Such a 5° finished variance from the ideal will provoke dissatisfaction from the diner who is particular about the doneness level he wants. With such narrow temperature variances between the four levels of doneness, prior art ovens could not achieve commercially a particular level for each and all of a multiple number of roasts in one oven cavity.

The narrowness of such 5° variance levels can be appreciated when one considers that commercial oven thermostats commonly have cycling ranges that have a 30° temperature range of 15° over and 15° under the thermostat switch-on-off point. Add to that consideration the need to come at least within 2.5°± of each of the ideal 5° temperature separations in order to stay out of the adjacent ideal temperature levels, and then one who is knowledgeable in the oven industry will immediately recognize the difficulties experienced with prior-art ovens in trying to stay within the critical 5° heat parameter required for each of the four doneness levels.

B. The Practical Achievement of These Levels.

The achievement of any one of these critical levels of doneness per se is controlled by the level of heat surrounding the cooking meat. The level of heat in an oven is the basic factor producing the level of doneness of the roasting meat. Another way of saying this is: The level of doneness is a functional result of the level of heat. Superficially considered this should mean that to finish a beef roast uniformly throughout at the 145° level for perfect medium-rare, no part of the meat should be at an internal finished heat of 150° (the heat level for medium) or at 140° (the heat level for rare). It should be only at 145°, or at worst within 2.5° thereof throughout its entire length and width during its entire time of cooking.

Actually, however, this is not true. The 140°, 145°, 150°, and 155° levels of internal heat respectively required for the doneness levels of rare, medium-rare, medium, and medium-well do not require the meat to be cooked at these levels of heat.

The final finished-result critical levels of doneness can also be achieved by cooking at any higher temperature under 212° provided: (1) the cooking is not continued beyond the time that the center of the roast has reached the desired level of doneness heat; and (2) that all the roasts in the oven are subjected to the same *average* level of heat at all times during the cooking time. If this appears to be contradictory to our general thesis of the need for specific heat levels for specific doneness levels, it is due to the little recognized phenomena that the distribution of heat throughout a substantially aqueous medium (beef protein meat will average about 75% juice) does not reach the level of a higher outside temperature with which it is exchanging heat until the *entire* body of the aqueous medium has reached that level. Thus, it is safely possible to cook beef at 180° and still finish out at 145° medium-rare. This higher temperature, but under 212°, cooking is therefore permissible in the interest of reducing cooking time. The critical consideration is to maintain the same level of heat, within any of the permissible oven heats, for each and every one of a multiple number of beef roasts in the same oven.

To maintain the temperature in an oven containing a multiple number of beef roasts so that each and all of the several roasts are constantly exposed to the same level of heat, and each individually and all collectively will finish throughout at the same required critical level of internal heat, even though the roasting is done above the required finished level of heat, has never been accomplished by the prior art. To target in on a precise finished temperature level centered within a 5° parameter, and hold it within this parameter, is an accomplishment that prior art commercial ovens have not been able to achieve with a multiple number of beef roasts in one oven.

C. The Need for Tight Controls Within Practical Parameters.

It is understood, therefore, that to finish out at the ideal level of internal heat for a specific level of doneness, the 5° spread between the different levels of doneness within an individual roast should be tightly controlled. Otherwise one end may be done medium and the other end medium-rare; or worse, one end may be well-done and the other end rare. To keep these levels of doneness as distinctly separate as possible, there should be no more than a 2.5°± variation from the ideal internal heat for a specific level of doneness. Thus, even though this would be a 2.5° shade of heat away from perfection, this is acceptable to the consumer. For practical purposes this means that a person who wants his meat to be medium will settle for a slice that is midway between medium and medium-rare; and a person who wants it rare will be satisfied with meat that is midway between rare and medium-rare. In other words, a 5° parameter circumscribing the perfect internal heat of finished prime ribs should be the goal of an oven designed for roasting prime ribs of beef.

This temperature parameter is so narrow that the heat-producing and distributing factors within prior art ovens have not been able to produce it evenly when a multiple number of roasts are in the same oven cavity. Not only have they not been able to produce it, but there has been no knowledge within the oven industry of even how to go about making ovens that can do it. There is no literature in the art to indicate that the industry has focused on this problem and, to the best knowledge of the inventors, the several factors influencing the desired end result have never been subjected to detailed instrumentation in an effort to solve the problem.

It is therefore an objective of this invention to cook a multiple number of beef roasts in a single oven cavity so that each and every individual roast will be exposed to the same average level of oven heat within the wide range of heats under 212° and will finish cooking at a temperature well within the specific 5°± temperature parameter of whichever one of the four critical levels of doneness is chosen.

3. The Problem-Factor of the Uniformity and Extent of the Levels of Doneness.

The evenness of the doneness, as it applies to the uniformity and the extent of a given level of doneness throughout a single beef roast, has also been an age-old problem of the beef-roasting industry.

Even with a single roast in an oven the prior art methods have not been able to achieve a universal uniform level of doneness throughout a beef roast. It was possible to do so but, not being cognizant of the physical laws governing heat distribution, the prior art did not knowledgeably teach how to achieve the desired result. Then, when the attempt was made to do so with multiple numbers of roasts in an oven, it was even more unachievable. Standard practice in the prior art has resulted in beef roasts that are one level of doneness at the center and various levels of more-done out to the periphery. For example, if the desired doneness is for rare, it will be rare at the center, then medium-rare further out from the center, then medium still further out, and finally well-done around the periphery. The industry has not been able to achieve an even uniform doneness throughout, from end-to-end and from skin-edge to skin-edge, especially with any one of the delicate most-in-demand doneness levels of rare, medium-rare, medium, and medium-well, with a multiple number of beef roasts in one oven cavity.

Very few, if any, chefs in the meat cooking industry are aware that the extent of doneness is strictly a function of time, provided the heat in an oven is held at the level required for a specific level of doneness in the finished meat. For example, if the medium-rare level of 145° internal heat is to be attained throughout an entire roast, it should be cooked for whatever length of time is necessary for the 145° level of even heat to permeat the entire roast. It is obvious, of course, that the length of time will depend on the thickness of the roast; the thicker the roast the longer the time, and the thinner the roast, the shorter the time, all other factors being the same. Nor are chefs aware of the fact that once the 145° level has been reached and then a 145° level is maintained in the oven thereafter, the cooking can continue indefinitely and the meat will never become any more done than the medium-rare level.

Therefore, to achieve uniformity of doneness throughout the entire extent of a meat roast, it would seem obvious that the heat within an oven cavity must also be uniform at all points at which the heat touches the surfaces of the meat. In the prior art as it applies to beef roasts, such uniform distribution of heat has never been achieved. Even if a constant input of heat was maintained, the prior art ovens could not distribute heat uniformly across the entire surfaces of all of a multiple number of roasts within a single oven cavity loaded to capacity. Several factors such as: (a) the multiple number of roasts; (b) their positions vis-a-vis themselves, the oven walls, and the source of heat; and (c) the uneven disparate contours of the several roasts all had influence in producing the impossibility of a uniform level of doneness extending throughout each and every one of a multiple number of roasts in prior art ovens.

To make matters worse, the relatively long number of hours involved with beef roasts progressively widened the lack of uniformity. For example, if one end of a beef roast is subjected Io an average ambient oven heat of 160° (well-done) and the other end is at 140° (rare), which is not an unusual situation in prior art ovens, the one end can finish to a well-done level while the other end is still raw (not even near the 140° rare level).

It is a specific objective, therefore, to provide an oven design that will facilitate the distribution of heat uniformly across, throughout, and within the entire exterior and interior areas of every individual beef roast in a fully loaded oven containing a multiple number of them.

4. The Problem-Factor of Heat Stratification, Or Vertical Distribution.

It is well understood in the field of physics that within a given atmosphere containing ambient air of varying temperatures, the hotter air will rise and the colder air will fall. If the ambient air in this given atmosphere is left relatively undisturbed and protected against physical disturbance and temperature change; i.e., if it is in a closed atmosphere protected against the addition of new heats, it will come to a state of relative rest in stratified layers of different temperatures. The stratification levels will be governed by the temperatures of the ambient air; again with the hottest at the top and the coldest at the bottom of the closed atmosphere. Thus the greater the distance (height) between the top and bottom of an oven cavity, the greater will be the temperature differences and numbers of measurable heat strata, between the top and bottom, and vice versa, the lesser the distance, the narrower will be the temperature differences and numbers of heat strata.

Stratification, albeit of an interrupted nature, also takes place in a closed atmosphere in which there is addition, subtraction, and exchange of heats. This is true, for example, in a closed oven with an on-off thermostat switch. It does not require much height in such a cooking oven to produce temperature differences of 20° between the top and bottom. For example, in an oven of a 36 inch cavity height, holding a multiple number of meat roasts at difference elevations, and operating at an average temperature of 180° for a projected medium-rare result at 140° in 5½ hours, the end result can easily show a 20° average internal temperature difference between the top and bottom meat roasts. This is the difference between a roast that is rare and one that is well-done. Such a difference in a restaurant that caters to a clientele that demands either rare or well-done beef roasts can be disastrous to its business.

To achieve a practical modicum of uniform and even heat exposure for a multiple number of beef roasts in an oven cavity, all such roasts should be held within a single heat stratum of the several strata comprising the heat stratification levels within a given oven cavity needed to obtain a specific finished doneness level. We say a "practical modicum" because a meat roast may span several heat strata. To achieve a "practical modicum," therefore, it is necessary that the heat span, of whatever strata encompassing a given meat roast, does not exceed the 10° (5°±) temperature parameter that separates the doneness levels above and below a specifically desired level of meat doneness.

Ideally the heat strata should not span more than the 5° (2.5°±) separations between each level of doneness. But if they span 10°, and if the roasting meat is centered within the 10° span it will, for all practical purposes be cooking at an average temperature level exactly on the desired perfect temperature level, provided that they do not exceed at any temperature point the temperature levels of the adjacent upper and lower levels of doneness. Our experience in the market has indicated that diners who desire a prime-rib roast medium-rare will usually accept it close to either the medium or rare levels if that is necessary, especially those prepared under the Peters patents. Thus, the 10° temperature parameter established by the 5°± separations between the different levels of doneness is an acceptable, even if not the perfect parameter, under which an oven must perform for prime-rib customers.

It is an objective of this invention, therefore, to provide an oven that reduces the temperature difference between the top and bottom of its cooking cavity to a minimum, and for all practical purposes to eliminate this disparity to the extent of holding it to an average temperature within the 10° parameter circumscribed by the 5°± temperatures separating an ideal doneness level from levels above and below the ideal.

5. The Problem-Factor of Horizontal Heat Distribution.

This is the problem of side-to-side distribution of heat. In an empty oven there is no obstruction to, or interruption of, the vertically layered strata of multiple-temperatured air. There is no obstruction to interrupt the formation of stratified patterns as the ambient air freely rises and falls as its temperatures dictate. The horizontal side-to-side evenness of air distribution is then automatically determined by nature's law of heat stratification. No horizontal extensions of the several strata are broken in an empty oven until new hot energy is discharged into it. Then new natural convection movements and turbulence takes place as the new hotter air rises and the older colder air descends until the discharge is switched off and each temperatured quantum of air can fit itself into its own stratum. Thus, in an empty oven the assembly of heat strata automatically provides horizontal even distribution at the various stratified levels.

But when an oven is filled with cold beef roasts, the evenness of horizontal, as well as the vertical, air distribution is seriously interrupted. The cold meat and the hot strata engage in heat exchanges that produce gentle movement, turbulence, and realignment of the vertical and, therefore, of the horizontal, heat distribution within a cooking oven. In prior art ovens filled with beef roasts, the effects of such realignment result in a distribution of heat that is highly unpredictable. The beef roasts are roadblocks in the paths of the stratification pressures endeavoring to establish the various levels of heat strata. In pushing its way up and down, air will bypass the roadblocks set up by the roasts. Pockets of undisturbed cool air (cooled by the cold meat) are thereby created. It is a phenomena whose effect on the doneness levels of roasting beef can be highly detrimental, and so a brief examination of the phenomena is germane to an understanding of this invention.

In physics the word "convection" is used to describe the transfers and/or distribution of heat by the circulation or movement of its carrier (liquid or gas). In this invention the carrier is, of course, oven air. This convection may be produced by:

a. The natural movement of hot air rising and cold air falling.

This is known as natural convection and its movement follows the natural paths of rising and falling heat levels. In the prior art its effect on the horizontal evenness of its distribution is unpredictable in an oven filled with a multiple number of meat roasts because there are no functional oven structures designed to provide equal heat exposure to oven heat for each and all of the roasts. However, the unpredictable results arising from natural convection are benign and minimal compared with the predictably gross and maximally bad results from:

b. Forced air convection.

This is accomplished by the widely-used method of an electric motor moving propeller blades. The practitioners of this method allege that the paths of their forced airstream can be directed and controlled to provide even horizontal distribution of heat to all of a multiple number of roasts within an oven. Their allegations have been so persuasive that today the majority of institutional-type electrical ovens are equipped to operate with forced-air convection. Gas-fired ovens have not lent themselves so readily to this practice because of the danger that the forced airstream might snuff out the burning gas.

Despite the allegations of its proponents, the claim of providing even heat to all of a multiple number of beef roasts and to all surface areas of each individual roast is patently false. It is scientifically, empirically, and commercially impossible. The proof of its falsity is contained in the proven law of physics covering fluid systems, discovered by Daniel Bernoulli, the 18th century Swiss physicist, known as Bernoulli's Principle: "The pressure in a fluid (air or liquid) decreases with increased velocity of the fluid." We will briefly examine the effects of this law in a meat-roasting oven.

Among the phenomena that shaped the formulation of his Principle, Bernoulli had observed that when a fluid flows through a narrowed constriction, its velocity increases. He observed for example the increased velocity of water in a brook flowing in the narrow parts of the stream. The water had to speed up in the narrowed parts if the flow was to be continuous. How did it pick up the extra speed? Bernoulli correctly reasoned that this extra speed was acquired at the expense of a lowered internal pressure.

The empirical application of Bernoulli's Principle to the mechanically forced movement of oven heat translates to: The pressure of a forced hot airstream moving against, across, and away from cold meat in an oven decreases with increased velocity of the air. In assessing the effect of such increased velocities and decreased airstream pressures on the meat, we must first understand that an oven is simply a heat exchange instrument and then take note of three ancillary phenomena:

(a) That the meat itself is a solid (i.e., immovable) barrier to any airstream; similar to large boulders in a stream of water. To bypass such a barrier the airstream must divide into separate airstreams of increased velocities and decreased pressures.

(b) That the meat itself is substantially impermeable to any slight pressures that might be produced by unintentional eddies or pockets created by the forced airstreams. There is no cooking by static and/or injected pressures; by what is called "pressure cooking," in which a breakdown of meat-cell tissues is involved. The heat exchange that does take place involves a reduction, not an increase of pressure.

(c) That by increased velocity and decreased pressure we have a phenomenon that increases the speed of the heat exchange. The effect is the same as increasing the temperature of quiet ambient air.

For example in our northern states during the winter there is a commonly experienced outdoors phenomenon referred to as "wind-chill" temperature. This phenomenon involves an accelerated heat exchange between a hot human body and a cold atmosphere. The National Weather Service compiled a "wind chill index" to measure the effect of this heat exchange when the atmosphere becomes substantially colder than the 98.6° temperature of the human body and the velocities of the atmosphere's ambient air changes. Thus, if quiet ambient atmospheric temperature is 0° and the wind speed is 5 mph, equal to 440 cfm (cubic feet per minute), the "wind chill" temperture is −5°; i.e., the wind striking a person's skin creates a rate of heat exchange equal to that produced by a temperature 5° colder with no wind; as if the quiet ambient temperature was −5° instead of 0°. If the wind speed is increased to four times greater; i.e., to 20 mph (equal to 1760 cfm) the "wind chill" temperature plunges to −39°, or eight times colder than at the 5 mph wind speed. As wind velocities increase, the "wind chill" temperature decreases on a gradually decreasing differential curve until the wind speed reaches 40 mph. At that point the speed is eight times greater and the "wind chill" temperature is 10 times lower. Wind speeds greater than 40 mph have little additional chilling effect.

A similar phenomenon occurs at the hot end of the heat scale; i.e., when a heat exchange takes place in an atmosphere that is substantially hotter than an object within the atmosphere. For example, were the air within an oven (atmosphere) is substantially hotter than a meat roast (object), hot air velocities create a phenomenon that exerts an elevated heat effect at the surface of the meat. We will coin a new phrase for this hot air phenomenon in an oven by naming it the "hot wind index." Thus, if the ambient heat in an oven is 180°, and the velocity of the air at the meat surface is 440 cfm, which is the lowest normal air speed produced by the fans used in food warming type ovens, our "hot wind index" will show a temperature of approximately 185°. The meat is actually cooking; i.e., a heat exchange is taking place, at 5° higher than would take place with resting ambient air in the oven. Then, if the wind speed is increased to four times greater; i.e., to 1760 cfm, which is not an unusual speed in forced air ovens, the "hot wind index" temperature jumps approximately eight times; i.e., by 42° to 227°, which is 12° over the point at which water (meat juice) turns to steam with consequent expansion and breaking of juice cells and resultant loss of meat juice. As wind velocities increase, the "hot wind index" temperature increases on a gradually increasing differential curve until the wind speed reaches 3520 cfm. At that point, the speed is eight times greater and the "hot wind" temperature is ten times higher. Wind speed over 3520 cfm has little additional heating effect.

It is especially significant for this invention to note that when airstream movements drop to under 440 cfm they have no increased effect on heat-exchange speeds or surface temperatures over the effects that are produced by natural convection stratification-movements. The small temperature variants produced by the small air-speed movements of natural convection are well within the 5°± variance permitted and the 10° parameter required, to produce individually the four delicate ideal temperature levels of doneness for prime rib beef roasts.

The application of Bernoulli's Principle with its ancillary phenomena creates within a forced-air convection oven the following three results for roasting meat. The following is a simplified example of the diverse and complex affects of a forced hot-air airstream as it moves horizontally over the length of the meat roast:

(1) The entry of the horizontally-directed airstream first strikes the front end of the roast with its hottest air; i.e., before it has passed over the cold meat. On impact, it immediately re-positions its single direction into multiple directions as it seeks ways around the meat roadblock. At this point the multiple redirectioned airstreams are flowing in restricted paths with increased speeds at decreased pressures and thus with increased "hot wind index" heats, and thus, too, with faster heat exchanges taking place.

(2) As the newly-directed airstreams clear the frontend edges of the meat and again are free to re-position themselves to follow their original horizontal direction across the lengthwise surfaces of the meat they are normally in restricted pathways with resulting increased speeds, decreased pressures, and increased "hot wind index" heats, and faster heat exchanges compared with such factors existing in the initial uninterrupted airstream.

(3) Then, as the lengthwise-to-meat-surface airstreams clear the rear end of the meat, and before they reunite into a single airstream, another well-known phenomenon inherent in Bernoulli's Principle occurs. The multiple fast moving airstreams create a "dead air" pocket of pressureless air at the rear end of the meat roast before they reunite into a single airstream. Because of this, the heat exchange between cold meat and "dead air" at the rear end of the meat is extremely slow, and may be practically non-existent. Roasts subjected to the above conditions can finish out with the rear end raw (uncooked) while the front end is well done.

We have briefly described the deleterious effect of the prior art's extensively used method of mechanically forced air convection in connection with initial horizontally directioned heat distribution and then its multidirectional redistribution. Its deleterious effects are equally felt in any and all of the (vertical, diagonal, multi-angled) directions oven airstreams can and do take. Airstreams follow the path of least resistance. Even though it may be the intention of an oven's construction that an airstream follow a horizontal direction, the size, quantity, and positioning of a multiple number of beef roasts in the oven, may completely upset the intention. Instead of following in generally horizontal directions, the airstreams normally are broken up into numerous vertical, diagonal, and multi-angled directions, each in varying degrees producing the same deleterious results described in our previous horizontally-directioned example of the action of Bernoulli's Principle.

We have described how the influences created by Bernoulli's Principle governing fluid air will create a situation in which different areas of a single meat roast may be cooking under three different heat flow speeds, three different heat-pressures, three different heat-exchange speeds, and three different heat-levels. Thus, at least three different levels of doneness come out of one roast. In actual practice, because of variations in the sizes and positionings in an oven of a multiple number of roasts, the results are even more highly variable and unpredictable. There are frequently more than three different levels of doneness in one roast and as many different finished results as there are roasts in an oven.

We have described this extensively-used method of forced-air convection to indicate the extent and nature of the problem currently existing in the meat-roasting industry and the need for understanding the cause of the problem before a cure could be found. We have done this to emphasize the lamentable fact that the oven industry has blindly and ignorantly disregarded Bernoulli's Principle in its use of forced-air convection for oven heat distribution. In so doing, it has maximized the deleterious results that have traditionally plagued the beef-roasting industry, particularly that area requiring rare, medium-rare, medium, and medium-well levels of doneness.

Thus, by noting the laws governing fluid systems and the lethal effects to beef-roasting uniformity that accompany forced-air convection, and the more beneficient effects that could be achieved by natural (non-mechanically forced) minimal movement air convection, we reached a knowledgeable approach by and from which to formulate an intelligible and intelligent oven structure for roasting beef.

It is, therefore, another object of this invention to provide an oven that will take full cognizance and full avoidance of the deleterious effects of the proven law of physics known as Bernoulli's Principle as it applies to hot moving air within a beef roasting oven containing a multiple number of beef roasts, and use only the air movements and/or speeds created by natural stratification and convection, which moves oven heat with minimal speeds under 440 cfm and, therefore, with minimal pressure differences and minimal speed-of-heat exchange differences, all of which combine to keep the rates of heat exchange temperatures centered with the 10° temperature parameters for the four critical levels of doneness.

6. The Problem-Factor of Heat-Input Density

Another way of stating this problem factor is to refer to it with a term more understandable to the layman, namely: heat intensity. When referring to heat density or intensity in relation to an electrical roasting oven, the term is correctly defined as follows:

Density is the quantity of electrical power (heat per unit area) of the heating element. The unit used to express electrical power (heat) is the watt. The watt itself is the voltage-pressure of the electrical current at the point of power emission from the heating element of the oven. The quantity of watts, or wattage, translates to the quantity of heat; commonly known as the level, or temperature of heat.

To measure the *quantity* (density) of wattage, the *level* (temperature) of wattage is divided by the square inches of sheath surface in a heated length of electrical element. But a layman in electrical-heat technology, like a chef, does not have the instrumentation to measure sheath surfaces.

To give such practitioners of our new oven art clearly visible evidence of watt density, we use the color of a heating element. The density of 10 watts per square sheath inch is the approximate dividing point between color and no color. Above 10 watts the element will begin to show a glow of dull red-orange color. The higher the wattage per square sheath inch, the brighter will be the color. Below 10 watts, the element retains the natural color of the element's metal and there is no visible evidence of heat emission. In the electrical industry, wattage output above 10 watts per square sheath inch with glowing-colored elements is known as high-watt density, and the output below 10 watts with no coloration of the elements is known as low-watt density. A brief consideration of the effect on beef roasting from each density is important.

A thermostat commonly turns an oven element on and off, and controls the frequency and amount of oven heat input. A thermostat does not switch on until its sensor in the oven has reached the low point of the thermostat's on-off cycling range. Then, in the interest of time, i.e., of elevating the ambient oven temperature as quickly as possible back up to the desired cooking temperature, the heating element is normally given a watt density output far in excess of the desired cooking temperatures. It is during the time of such high-heat input that some of the most lethally detrimental effects for beef roast cookery take place.

Under the system of beef cookery disclosed in Peters U.S. Pat. Nos. 3,804,965; 3,876,812; and 3,962,961, oven temperatures may not exceed 212° F., and should be maintained at no more than a 180° average. However, the heating elements used in practically all prior art ovens have a heat input at the point of emission of upwards of 450°. At such temperatures they glow at a light-colored orange-red. If, as is common in the prior art, this heat input enters the oven within a few inches of the cooking meat, and/or if it becomes blocked underneath the meat, it will cook the meat at temperatures far in excess of the 212° limit set by Peters and completely negate the quality specifications of Peters' beef roasting system. Such blockages and high-watt density heats are normal phenomena in the prior art. They create and produce thermal shocks for the cooking meat inside an oven. A thermal shock in this instance is a fast, high, intermittent application of heat far in excess of 212° F. whereby the juice in roasting meat is changed from the liquid phase and expands into the steam vapor phase whereby meat cells are broken and valuable protein juice is lost. Each of the scores of times that the heating elements in prior art ovens are energized by their thermostats during a normal 5½ hour cooking time for beef roasts, the cooking meat nearest the elements is subjected to these thermal shocks.

The prior art has attempted to eliminate such blockages and thermal shocks by allegedly distributing heat input quickly and evenly with mechanically-forced air movement. It does eleminate blockage in and around the immediate area of heat input but, as noted previously, under the application of Bernoulli's Principle it does not and cannot distribute heat evenly throughout a meat-filled oven.

To eliminate the lethal cooking effects of thermal shock, and avoid the consequences that come from the prior art's disregard of Bernoulli's Principle, it is an object of this invention to provide an oven having an electrical heating element of low-watt density and, thus, a low and slow rate of heat input which is distributed by the low airstream velocities of natural convection and stratification.

7. The Problem-Factor of Commercial Practicality.

If our oven problem is solved in a manner that is so complicated and costly, either to build and/or operate, that the cooking industry finds it uneconomical to purchase and/or operate, then it is of no benefit to society. To be of benefit it must be commercially practical and acceptable. For this invention, that means an oven that is inexpensive to manufacture, simple to maintain, easy to use with unskilled labor, and cooks more roasts in less space than prior art ovens. This also means an oven for roasting beef that for the first time in the food-service industry would fit the requirements of a fast-food operation.

The prior art has made many attempts to provide an even distribution of heat to a multiple number of beef roasts cooking in the same oven cavity. All of them have had one or more serious commercial liabilities. There have been "ferris wheel" structures whereby beef roasts are rotated to expose all roasts equally to the various temperatures and air-flow patterns within an oven. There have been heating element wires wound completely around four sides (top, bottom, and two sides) to provide an allegedly evenly distributed and spaced input of heat for the roasts in the oven. There have been oven inner cavities built within oven outer cavities to provide plenums and/or conduits to distribute heated air evenly either with or without forced air. There have been ovens with equal heating elements located at both the top and bottom of an oven cavity allegedly to eliminate heat stratification and equalize heat distribution between top and bottom meat roasts.

However, all of these prior art attempts have increased construction costs; rendered maintenance and servicing difficult and/or impossible in the restaurant, some actually requiring return to the factory for repair; and a disregard of one or more of the laws of physics referred to above. By virtue of such deficiencies, prior art ovens have rendered the cooking of beef roasts a highly uncertain venture for uniformly finished results, and therefore very costly because of the uncertain saleability of some of the finished beef roast results. All of these deficiencies have combined to render roasting and serving of "prime ribs" inoperative as a fast-food operation, or even as a viable low-cost operation for any type of restaurant. Prior art roasting of "prime ribs of beef" to the four critical levels of doneness has been practiced as an "art", surrounded with an aura of secrecy and mystique. Only high-priced chefs were assumed to have mastered the art. Actually, it was not even worthy of being called an art because no one in the industry appeared to have any knowledgeable basis for knowing what went on inside an oven and/or the effects of various kinds of heat on the roasting of "prime ribs of beef".

For all around high commercial practicality for roasting beef to the four critical levels of doneness, four ideal oven requisites must be present: the cooking process must be (1) fast; (2) simple and easy; and (3) the finished result superior to that of the prior art; and (4) its capital investment cost must be low.

It is therefore an object of this invention to provide an oven that will accomplish these four ideals in a commercially-practical manner with a multiple number of beef roasts cooking in the same oven cavity.

The inter-relationship of the seven problem factors bearing on a commercially-successful oven for roasting "prime ribs of beef", and the overall combined objective of the individual objectives may be summarized as follows:

An oven for roasting beef with methods and means specifically designed in combination for:

1. Roasting a multiple number of roasts at one time, and

2. Finishing them all, individually and collectively, to a doneness level within a 10° temperature parameter at the ideal doneness levels of 140°, 145°, 150°, and 155°, respectively, for rare, medium-rare, medium, and medium-well;

3. Extending the desired doneness level uniformly throughout from skin to skin, within each and every roast by means of 4. Confining horizontally-stratified vertically-stacked strata of heat within substantially a 10° temperature parameter, and simultaneously 5. Distributing such heat horizontally and uniformly, with air speeds produced only by natural convection and stratification, across and among said roasts, including 6. Controlling the density of the heat at the point of oven heat input to prevent thermal shock at said point to said roasts, and 7. Accomplishing all this with an oven structure that meets the four ideals for practical commercial cookery; namely: (a) speed; (b) simplicity; (c) superior finished results in the roasts; and (d) low capital cost.

In our description of the methods and means used to solve the seven problem factors, and thus fulfilling the seven objectives of this invention two features of the description are noteworthy: (a) the total simplicity of the preferred embodiment of our invention and (b) the new and unique combination and cooperation of old functional means whereby we have provided solutions to the several specific problem-factors involved in this invention.

DESCRIPTION OF THE DRAWINGS

The drawings show a specific preferred embodiment of our invention. It will be understood that the specifics of this embodiment may be varied without departing from the overall fulfillment of the invention's purpose.

The two cavities are made separate and distinct by an insulated barrier plate 9 that functions as the bottom inside wall of top cavity 8*a* and the top inside wall of cavity 8*b*. Each cavity has its own thermostats located behind thermostat dials 2*a* and 2*b*; its own pilot lights, the upper 3*a* and the lower 3*b*; and its own single open grill work shelf, the upper 10*a*, and the lower 10*b*; its own heating elements, the upper 11*a*, and the lower 11*b*. Upper cavity 8*a* is shown filled in front with meat-holding cartons 5*a*, 5*b*, and 5*c*, while lower cavity 8*b* is shown without any meat. The cartons are of the type described in U.S. Pat. No. 3,876,812, and sold under the trademark Cradle by Rarity Farms of Grand Rapids, Mich. Centered in the front of each carton are the exposed twisted tail-ends 12*a*, 12*b*, and 12*c* of the film in which each roast is encased, these tail-ends protruding through holes in the ends of each carton. The center carton 5*b* also shows the dial 13 of a meat thermometer whose sensor-probe has been inserted through the meat-encasing film into the meat itself.

Figure 3:
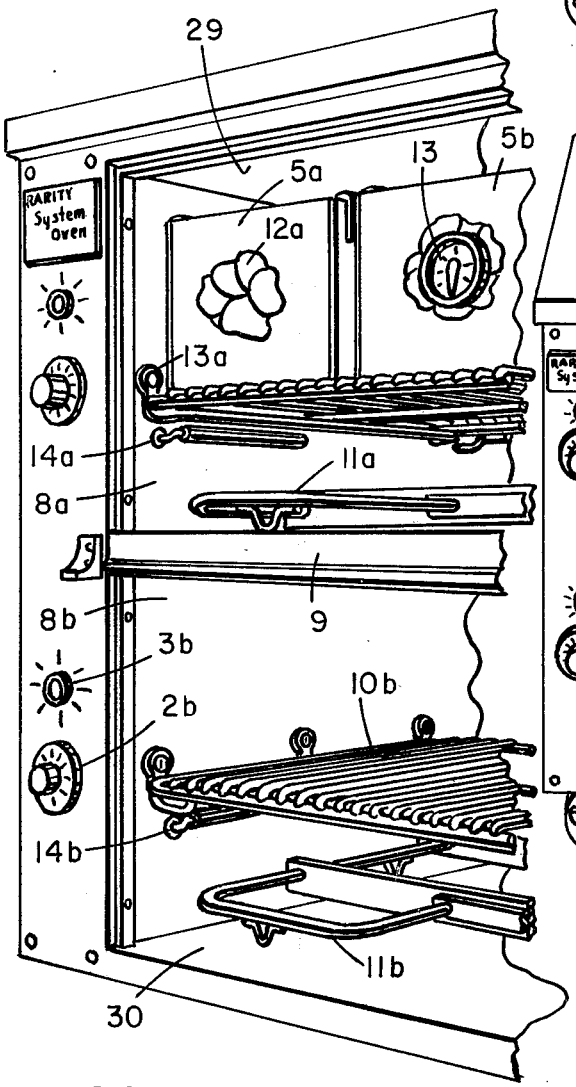

FIG. 3 is an enlarged fragmentary perspective view of the oven illustrating the location, relative size, and position relative to the other structures within the oven cavities of the thermostats' temperature sensor bulbs 14*a* for the upper cavity and 14*b* for the lower cavity. The ceiling 29 for the upper cavity, and the floor 30 for the lower cavity are also shown.

Figure 1:
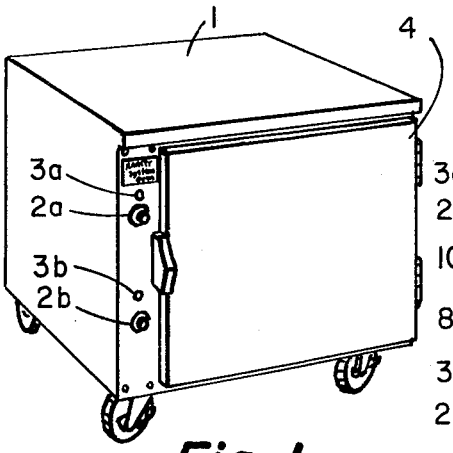
FIG. 1 is a perspective front view of the outside of our oven cabinet 1, and its two thermostat control dials 2*a* and 2*b*, two pilot lights 3*a* and 3*b*, and a single door 4 in closed position.
Figure 2:
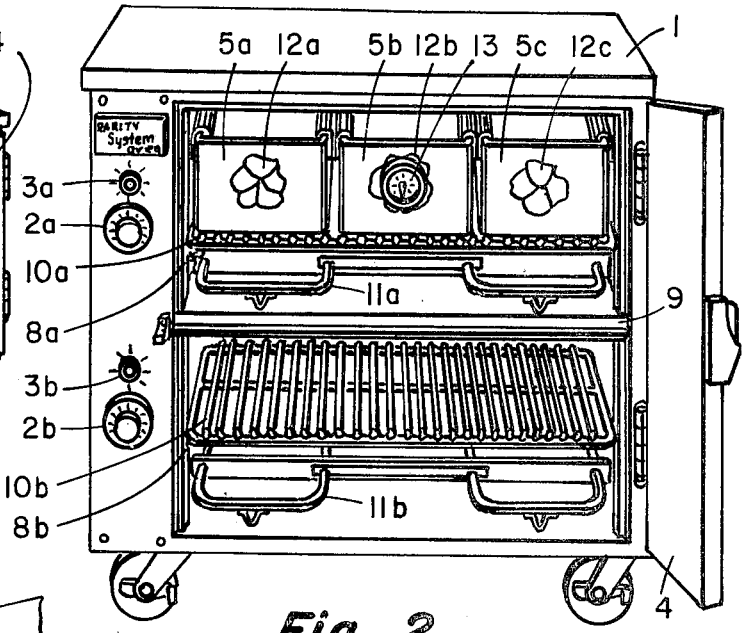
FIG. 2 is a perspective, front-on view illustrating the cabinet 1 with door 4 in open position. Inside the open cabinet are two separate and distinct oven cavities, an upper cavity 8*a* and lower cavity 8*b*. Each of these cavities embodies all of the distinctive functional features that make this invention unique. Each cavity is a complete and distinct oven in itself with its own controls and heating elements. This two-cavity oven cabinet is shown simply to compare simultaneously in single drawings the spacings and elevations between a roast-filled and an empty cavity. Each oven cavity is a complete oven in itself. This invention is directed to the unique functional structurings within an individual oven cavity.
Figure 4:
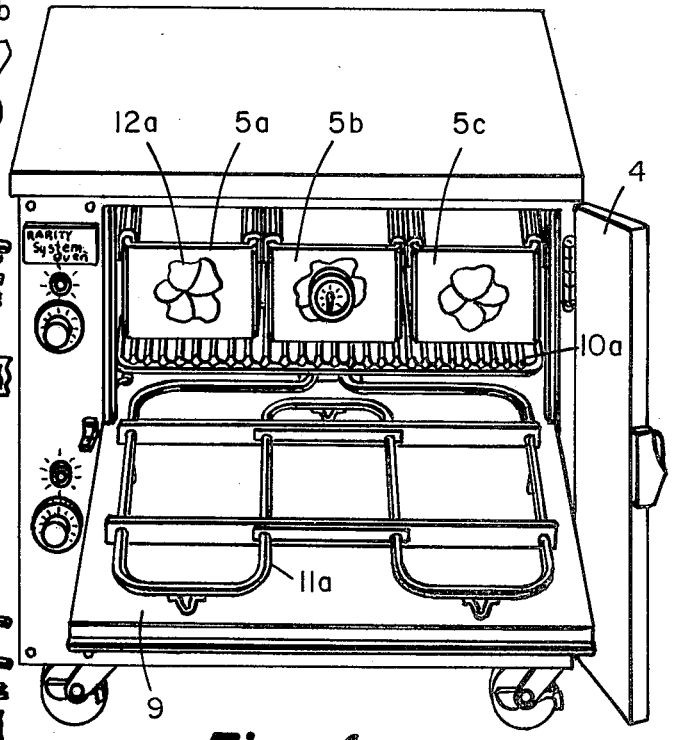
Figure 9:
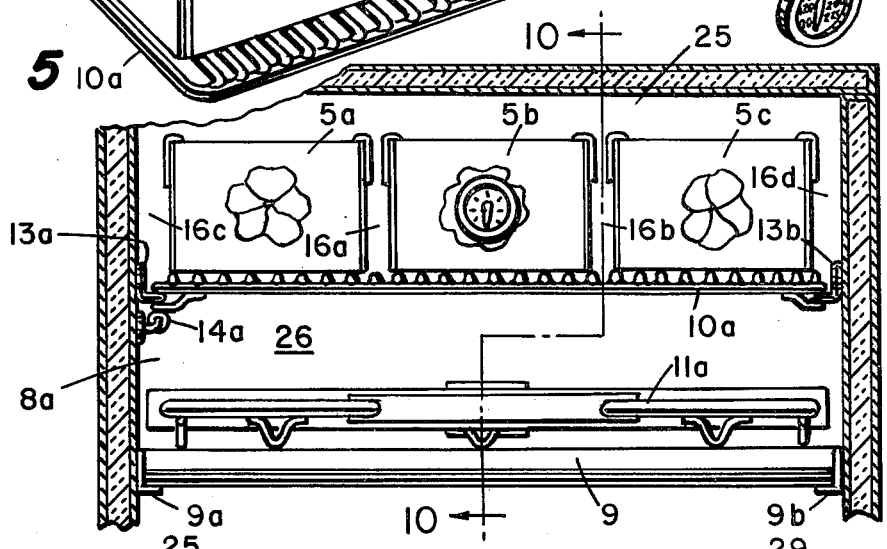

FIG. 4 is a similar view to FIG. 2, but showing the barrier plate 9 pulled out, and heating element 11*a* of upper cavity 8*a* pulled out along with it to illustrate the configuration of the element 11*a* and the manner in which it rests on the plate 9 inside the upper cavity. The barrier plate rests and slides on right-angle brackets fastened to the walls of the cabinet as best illustrated in FIG. 9 at 9*a* and 9*b*. With the barrier plate pulled out, the lower cavity is hidden from view in FIG. 4. This pullout feature of barrier plate 9 is a unique optional feature useful for cleaning purposes, but it is not claimed as part of this invention.

Figure 5:
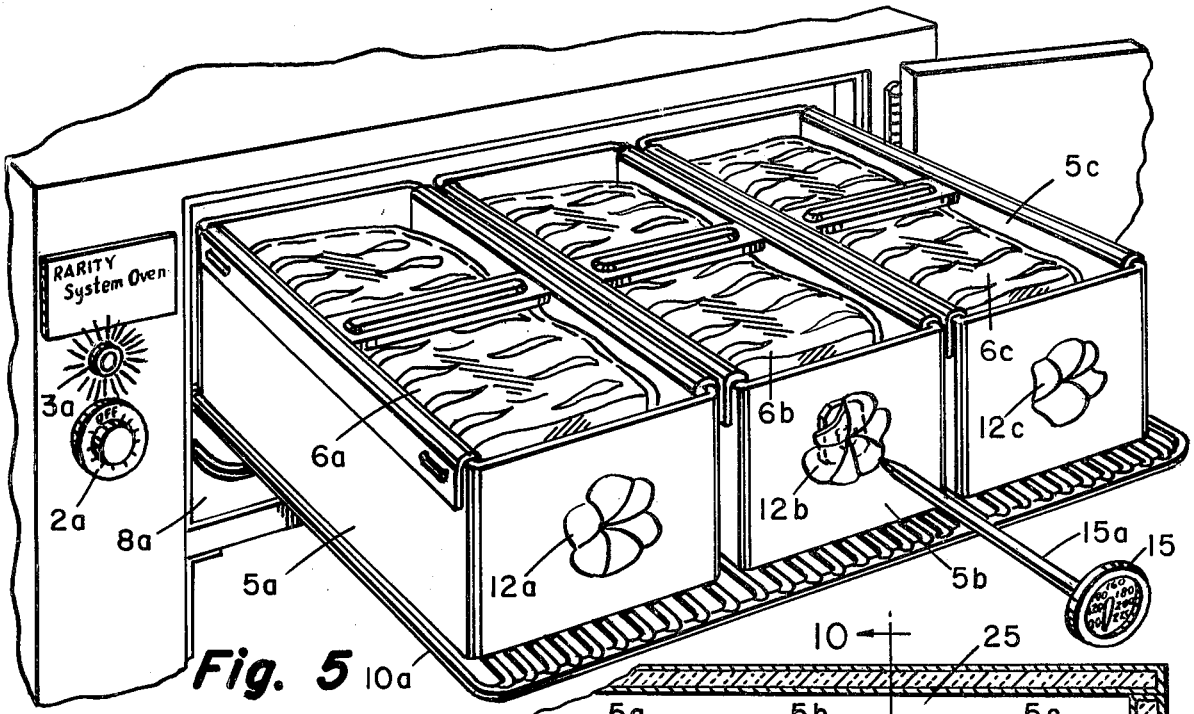

FIG. 5 is a fragmentary perspective view of FIG. 2 showing shelf 10*a* of cavity 8*a* pulled half-way out exposing three film-encased meat roasts 6*a*, 6*b*, and 6*c* within the cartons 5*a*, 5*b*, and 5*c*. This view also shows the twisted tail-ends 12*a*, 12*b*, and 12*c* of the meat encasing film protruding through holes in the end walls of said cartons. In front of center carton 5*b* and its tail-end 12*b* is meat thermometer 15 with its sensor probe 15*a* before insertion into the meat through the opening at the center of the twisted tail-end 12*b*. The uniform horizontal level at which each roast is held in our preferred oven by virtue of the cartons and the single shelf enable us to place a meat thermometer probe in only one roast to obtain a correct internal temperature reading and uniform level of doneness for all six. The shelf 10*a* is slidably supported by brackets 13*a* and 13*b* (FIG. 9).

Figure 10:
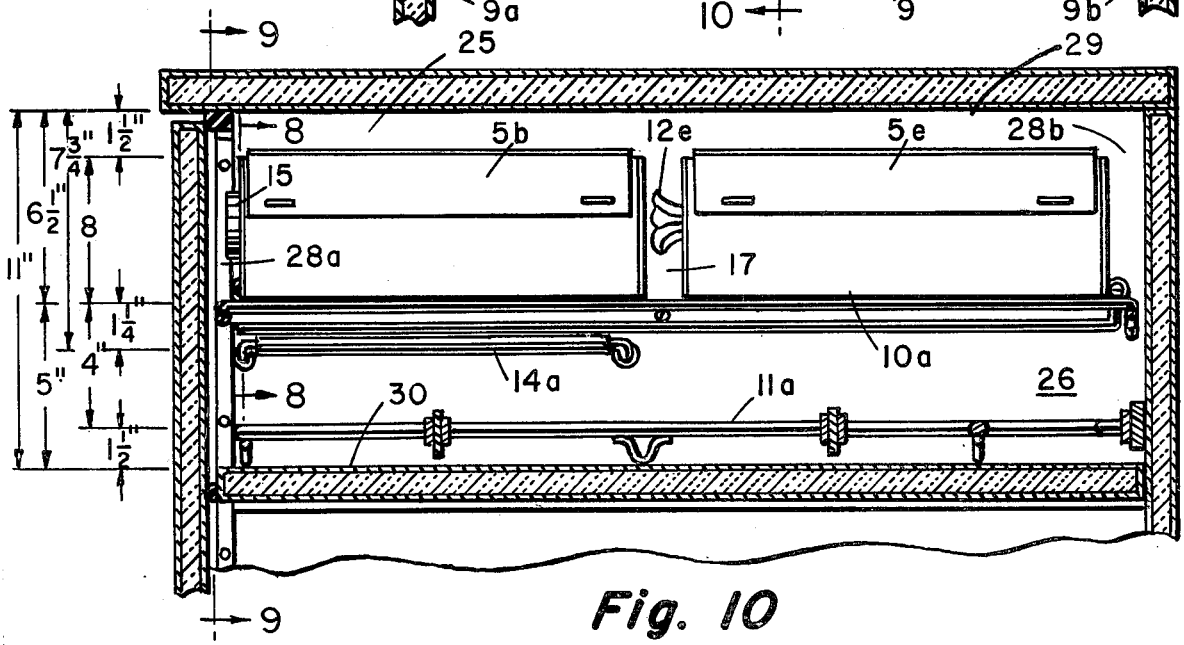
Figures 6, 7, 8:
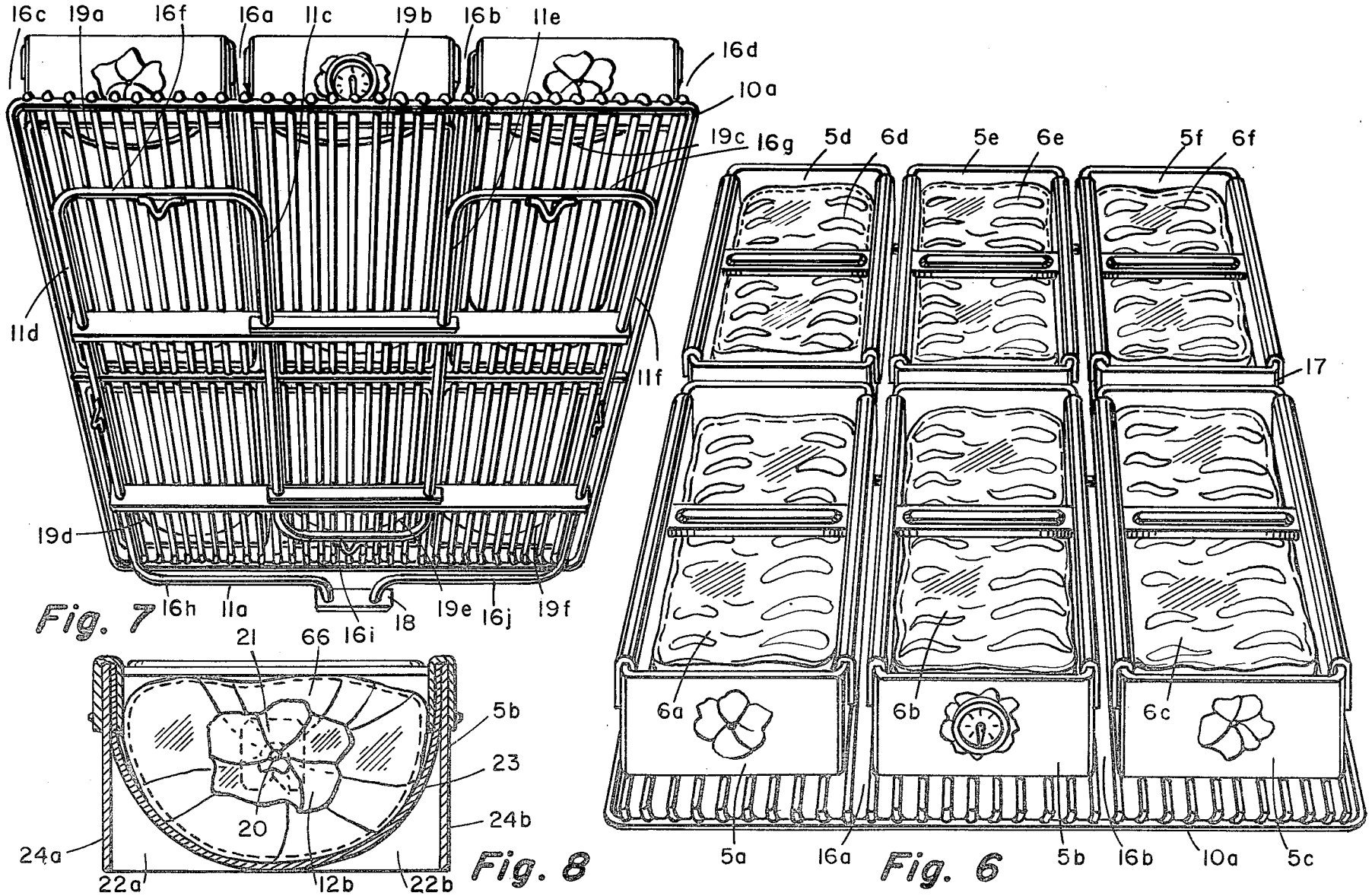

FIG. 6 is a full perspective view of the topside of shelf 10*a* of FIG. 2 fully loaded with meat-containing cartons 5*a*, 5*b*, 5*c*, 5*d*, 5*e*, and 5*f*, each containing film-encased meat roasts 6*a*, 6*b*, 6*c*, 6*d*, 6*e*, and 6*f*. The dimensions of the cartons are uniform and we are able to provide shelf dimensions that will accommodate six roasts per shelf with longitudinal open spaces 16*a* and 16*b*, a lateral space 17 between the front and rear cartons, and lateral spaces 28*a* and 28*b*, respectively, between the cartons and the front and rear walls of the oven as shown in FIG. 10. Natural air movements can therefore freely take place during the roasting process.

FIG. 7 shows the bottom side of FIG. 6 with a view taken from below element 11*a* in order to show the configuration of element 11*a* from its beginning to its ending in terminal block 18, and its alignment with longitudinal open inner spaces 16*a* and 16*b* and outer spaces 16*c* and 16*d*. Through the open grill work of shelf 10*a* is also shown the bottom views of the six cartons with their curved hammock-type structure visible at 19*a*, 19*b*, 19*c*, 19*d*, 19*e*, and 19*f*.

FIG. 8 is a cross sectional view of the carton 5*b* taken along the line 8—8 of FIG. 10. FIG. 8 shows the twisted tail-end 12*b* of the film 6*b* held in place by a plastic clip 21 and a hole 20 at its center. It also shows the open spaces 22*a* and 22*b* underneath the cartons formed by meat-shaped hammock 23 and its adjacent carton walls 24*a* and 24*b*. Heat flows into these open spaces and surrounds the curved surfaces of the roasting meat during the roasting process.

FIG. 9 is a sectional view through the front of the oven taken along the line 9—9 of FIG. 10. This view shows the important vertical and horizontal spacings and distances more fully detailed in FIG. 10, the head room 25 for the distribution of ambient heat above the meat-molding cartons 5*a*, 5*b*, and 5*c*, the longitudinal open spaces 16*a* and 16*b* between the cartons and the spaces 16*c* and 16*d* between the outside line of cartons and the oven cavity walls, and the relatively large open heat-dispersion heat-distribution space 26 between element 11*a* and shelf 10*a*.

FIG. 10 is a longitudinal cross-sectional view taken along the line 10—10 of FIG. 9 showing the following eight important elevational distances between the functional structures of the preferred embodiment of our oven, all of them cooperating to contribute to the even and equal distribution of heat to each one of a multiple number of roasts within each oven cavity:

The 11" elevational distance between top 29 and bottom 30 of the oven cavity;

The 6½" elevational distance between the shelf 10*a* and the top 29 of the oven cavity;

The 5" elevational distance between the shelf 10*a* and the bottom 30 of the oven cavity;

The 7¾" elevational distance between the thermostat sensor 14*a* and the top 29 of the oven cavity;

The 4" elevational distance between element 11*a* and shelf 10*a*;

The 1½" elevational distance between the top of cartons 5*b* and 5*e* and the top 29 of the oven cavity;

The 1¼" elevational distance between sensor 14*a* and shelf 10*a*;

The 1½" elevational distance between element 11*a* and bottom 30 of the oven cavity.

FIGS. 2 through 10 show details of our oven's interior structures and dimensions and their functional relationships to roasting meat. The meat used in this preferred embodiment of our invention is described in the previously-cited patents of Leo Peters. The meat of these patents is encased in the oven film and held and roasted in the Cradle cartons described in these patents. These items are illustrated herein throughout the drawings with the cartons as 5a, 5b, 5c, 5d, 5e, and 5f; the film as 6a, 6b, 6c, 6d, 6e, and 6f; and the meat as 7a, 7b, 7c, 7d, 7e, and 7f.

In examining the preferred embodiment with which our oven cavity structuring solves the seven problem-factors and thus meets the seven specific objectives of this invention, we follow the same order followed in the initial outline headed "Nature of the Problem".

DESCRIPTION OF A SPECIFIC EMBODIMENT

The solutions for each of the individual seven problem-factors and their objectives become parts of an interrelated, interdependent, and cooperative combined solution for the overall objective. Each specific objective and its specific functional structuring does have at least one specific role to play within the accomplishment of the overall objective. But this does not diminish the importance of each specific objective because each in combination with all the others contributes to the overall objective. In addition, some of the specific functional structures also assist in providing solutions to more than just one objective. Solutions to our seven objectives are as follows:

1. Equal heat treatment for each of a multiple number of roasts in one oven cavity is the broadest of the specific objectives. In fact it epitomizes the overall objective of "uniformly cooking three or more meat roasts to substantially equal, even, and uniform levels of doneness centered within a narrow 10° temperature parameter". The first function of this objective is to provide the correct spaced distances and elevations for and/or between the larger functional structures and the meat roasts, whereby said roasts are always centered within a 10° parameter stratum of cooking heat. These larger structures within our oven cavity are designed to provide the following four essential spaces and elevations:

a. The first essential space-elevation dimension is the overall interior height of 11 inches shown in FIG. 10. This is an unusually small height for an institutional oven and it is also smaller than most domestic ovens. This small height limits the extent of the heat stratification, and the number of heat strata, that can form in the stratification of oven heats. This height may be varied depending on the thickness of the meat item to be roasted, and only on the condition that the meat is centered within the roasting stratum. Our exemplary oven uses the eye of the rib for its meat. Thicker beef cuts such as whole ribs and cuts from the chuck and round may be used which would require an oven cavity height of about 14 inches.

b. The second essential space-elevational dimension is from the element 11a to the shelf 10a. This distance is 4 inches and provides an open free-air space 26 in which incoming heat from element 11a can spread, disperse, distribute, and level out before it reaches the meat-holding cartons resting on shelf 10a of FIG. 10. This free-air dispersion space is necessary to help prevent high heat-input shock that is experienced when the meat and heating element are too close together.

As will be noted in FIGS. 2, 3, and 4, each of the two oven cavities have only a single shelf, 10a and 10b, respectively, on which to rest meat roasts, and only a single source of heat, heating elements 11a and 11b, respectively. To facilitate initial equality of heat distribution from out heating elements to the meat roasts on our oven shelves, our preferred embodiment provides an element configuration shown in FIG. 7 that distributes heat substantially equally across and underneath the bottoms 19a–19f of the six meat-containing cartons resting on shelf 10a. The heating element 11a in FIG. 7 includes longitudinal portions 11c, 11d, 11e, and 11f which are substantially aligned with the longitudinal spaces 16a, 16c, 16b, and 16d, respectively, between the meat cartons, and transverse or end portions 16f and 16g, which are substantially aligned with the front transverse space 28a (FIG. 10) and transverse end portions 16h, 16i, and 16j which are substantially aligned with the rear transverse space 28b (FIG. 10).

But then to improved the meat-contacting heat from being just "substantially equal" to being fully equal, we provide a heat-distribution space 26 as shown in FIGS. 9 and 10. In our preferred embodiment we accomplish this with a 4 inch elevational distance between heating element 11a and meat-holding shelf 10a, as shown in FIG. 10. It will be understood that said equal heat distribution may be accomplished with other means such as metal plates, porous materials, glass-fibre screens, or mats, etc. between our heating elements and the meat, in which event the 4 inch distance could be reduced. However, in the interests of simplicity, cost, and cleanliness, we prefer the equal heat distribution provided by an adequate open air space as shown in the exemplary embodiment of our invention. The open air space has the prime advantage of allowing the heat to distribute and equalize itself freely without any directioning from an intermediate structure between the heating element and the meat.

c. The third essential space-elevational dimension is the distance or head-room 25, between the top of the meat-holding cartons 5b and 5e to the inside top 29 of the oven cavity in FIG. 10. This distance is only 1½ inches. Small as it is compared with similar provisions in other commercial ovens, it provides adequate head-room in which the natural convection and stratification of our ambient heat can evenly distribute itself across the top of the roasting meat. This distance should not exceed 2 inches.

d. The fourth essential space-elevation dimension shown in FIG. 10 is the distance of 1¼ inches from the thermostat sensor bulb 14a to the meat-holding cartons 5b and 5e on shelf 10a. A sensor bulb in any oven should always be located where it is protected against damage inside an oven. This is a requirement of Underwriters Laboratories whose seal of approval is required by Government fire ordinances. This is normally the only consideration determining its location. So, prior art ovens just normally locate their sensor bulbs sowewhere near the top of the cooking cavity.

Not only is this location constantly the hottest part of the oven, but also such a sensor location cannot be used to create and control a temperature differential with higher elevational heat and lower elevational heat within a given stratum. When a sensor is located at the top of an oven it can sense only at the highest elevational where the swing in temperatures is at its widest because the sensor must wait for the whole oven to cool down before it will switch on more heat. In this situation the only temperature differential available to the sensor is that produced by the extremes of temperatures within the entire oven cavity. Evidence of this is the characteristic long off-time and very short on-time of prior art oven thermostats. Normally, their on-time is 10% and off-time is 90% of the full cycle time. For roasting meat this means (1) that the highest meat in such an oven is done much earlier than the lowest meat in the oven, and (2) none of the meat at separate elevational levels finishes out equally.

However, to successfully achieve the narrow heat parameters imposed by the levels of doneness required for prime ribs, the sensor should always be located at an elevation that is within a 5° average ambient temperature stratum of the meat, and a maximum 10° average ambient temperature difference from the oven cavity's top, in order to maintain the closest practical temperature range within the cycling range of the oven's thermostat. To meet this objective in our preferred embodiment as shown in FIG. 10, we locate our sensor bulb 14*a*: (1) along an oven wall below and as close to meatholding shelf 10*a* as is physically practical; (a) as far as practically possible away from element 11*a*, but still between the meat-holding cartons 5*b* and 5*e* and the element 11*a*; then (2) at a distance of 1¼ inches below said meat-holding cartons that will leave said cartons midway in the 7.75 inch ambient heat stratum circumscribed by the sensor at the bottom of the stratum and the oven's ceiling at the top of the stratum.

We have thus created a special cooking space zone, within our oven cavity, that is designed for the meat alone whereby it rests within a zone or stratum of heat comprised of several strata with measurable differentials between the sensor and the top of the oven. This zone is in fact a compartment whose bottom is scribed by our thermostat's sensor, and its top and sides by the cavity's walls. Relative to the meat, the sensor is within 1.25 inches of the botom of the meat at the coldest part of the zone, while the top of the oven, within 1.5 inches of the top of the meat, remains the hottest part of the zone. This creates a temperature differential between the level of the sensor and the top of the oven dictated by the cooking space zone of the meat itself. Three of the uniquely advantageous results of this arrangement is that in our oven (a) the thermostat on-off times are about evenly divided within the full cycle time; (b) all our meat is subjected at all times to the same level of heat, and (c) all arrive at the same level of doneness at the same time.

2. The Problem-Factor of the Levels of Meat Doneness

This problem-factor is one of narrow 5° doneness levels. Prime ribs of beef require that the heat to which the meat is exposed be not only an equal exposure but be combined with a narrow level of exposure. This narrow level of exposure is accomplished primarily by narrowing the height in which stratification of the horizontal strata of heat, in which the meat is actually roasting, can take place.

The total strata of heats in an oven extend in layers from its bottom to its top. Since hot air rises and cold air descends, the temperature of resting ambient heat at the top is always higher than at the bottom. And the greater the height of the oven cavity, the greater will be the difference of temperature between the bottom and top. Because all of the roasts in our oven are held on one shelf they all lie within the same strata of heats. By keeping our oven cavity to the smallest practical height commensurate with the thickness of the meat, we restrict the number of heat strata to the smallest possible number dictated by the thickness of the roasts, and thus we reduce the difference between the bottom part and the top part of our meat roasts to the narrowest possible temperature difference.

Meat roasts used in our preferred oven embodiment will vary in diameter, or thickness, from about 2½" to 5'. To accommodate this variation, we tailored the height of our roasting stratum of heat to accommodate the 5" height of the Peters' roasting packages which, in turn, provide a uniform accommodation for the variations in meat roast thicknesses. To this 5" roasting package height we added an open 1½ inch height head room area 25 in FIG. 10 to produce a total heat-stratum height of only 6½ inches within which our oven holds meat roasts. This is the narrowest fixed heat-stratum space of any meat roasting oven on the market.

Then, to keep this stratum of heat within its narrow heat-height, we placed our heat sensor bulb 14*a* as close as possible to the bottom of the meat as the shelf structure allowed and still meet the physical protection requirement of UL, which is a distance of 1¼ inch as shown in FIG. 10. Since the top of the oven cavity confines the roasting heat stratum at the top and the sensor bulb restricts it at the bottom, we have a total heat-roasting stratum height from bottom to top of 7.75 inches. Within this height the meat and the middle of its thicknesses in our oven is almost exactly centered. No other prior oven was designed to center all its roasting meat within a prescribed heat stratum.

Regardless of the temperature level in which meat is roasted in our oven, the net result of the functional structuring detailed above is to maintain an average level heat-roasting stratum in which the meat is roasted well within the 10° average temperature parameter needed for the specific temperature levels of prime ribs of beef.

3. The Problem-Factor of the Uniformity and Extent of the Levels of Meat Doneness.

This problem-factor as it relates to prime rib doneness requires that the heat to which the meat is exposed be not only an equal and narrow level exposure but also a uniform exposure, extending at finish time throughout the entire body of the meat roast. The top, bottom, sides, and ends should share heat uniformly if the desired doneness level of the meat is to be achieved throughout every individual roast of a multiple number in our oven.

Our oven has a single source of heat; a heating element, located at the bottom of our oven cavity, having a configuration adapted to the layout of meat cartons filling our simple shelf. Thus, the heat input rises upward from one level, spreading uniformly across the entire bottom of our oven cavity as best illustrated in FIGS. 2, 4, and 7. As it rises to the top of the oven cavity, most of it will first uniformly contact the bottoms of the meat cartons and then pass through substantially equal longitudinal and verticalopen spaces 16*a*–16*d* (FIG. 9), the transverse and vertical open spaces 17, 28*a*, and 28*b* (FIG. 10). Thus, all of the open spaces surrounding all of the six meat roasts receive substantially an equal, narrow, and uniform quantity and level of heat in our oven cavity. This, in turn exposes our roasting meat to a uniformly extended narrow stratum of heat.

4. The Problem-Factor of Heat Stratification, or Vertical Distribution.

In addition to an equal, narrow, uniform distribution of heat throughout the meat roast, our oven's objective is also to provide an even vertical distribution of heat. By an even distribution of heat we do not mean the same thing as equal and/or a uniform distribution. An even level of doneness is our roasts means that they are all at the same level of doneness throughout. To accomplish this evenness the oven heat should always be evenly distributed across all the surfaces of the meat no matter what the level of the heat happens to be. Evenness of non-forced heat distribution is more directly a result of the stratification of static ambient air, while equal and uniform distribution is more directly a result of said ambient air in its movements.

Therefore, to meet our objectives of even vertical distribution of heat, our oven is structured so that the layers of heat strata within each of the open space vertical columns of confined ambient air can distribute themselves freely and naturally according to the law of heat stratification. Thus, each vertical open space column of air is similar to and even with every other vertical open space column of air in respect to openness and freedom of air passage as the heat rises and falls during our oven's heat-cycling changes.

The functional structures already described in the preceding paragraphs 1, 2, and 3 also provide the spacings needed for an even vertical distribution of heat. The functions served by our single shelf, the small height of our oven cavity, and the single-directioned upward movement of heat from the point of heat input, already contributing to the previous objectives, now contribute to arranging the heat strata of our ambient air around the roasting meat into even-temperatured layers of heat strata within all the vertical open spaces 16*a*–16*d*, 17, 28*a*, and 28*b* shown in our drawings. We thus provide an oven having only a single shelf within a single oven cavity whereby all of a multiple number of beef roasts rest and cook at the same even horizontal heat levels of the horizontally-stacked heat strata within each vertical column of heat.

5. The Problem-Factor of Horizontal Heat Distribution

In addition to an equal, narrow, uniform, and even vertical distribution, it is also our objective to provide an even horizontal distribution of heat.

Since our oven is limited to a single fixed-elevation horizontal shelf, all of the meat in our oven is in the same fixed horizontal plane, and thus in the same horizontal strata of heat that at any given moment encompasses all the meat. This sameness or evenness of these strata comprising the whole stratum encompassing the roasting meat at any given time is critically important for an even doneness throughout all of a number of roasts in our oven. Referring to FIG. 10, this stratum has its bottom borderline set by sensor bulb 14*a* and its top borderline set by the ceiling 29 of the oven cavity. The distance between these two borderlines is 7.75 inches. The distance from the top of the cartons to the ceiling of the oven cavity is 1.5 inches (heat space 25), and from the bottom of the cartons to the sensor bulb is 1.25 inches. Between the top and bottom of our 7.75 inch cooking stratum is 5.0 inches of meat-holding cartons. Thus the meat in our oven is horizontally almost perfectly and therefore evenly centered within our cooking stratum. The practical consideration defining the height of the cooking stratum is the maximum thickness of the meats to be raosted. For our exemplary oven this is 5.0 inches. The important consideration is the centering of the meat within the narrowest possible heat stratum commensurate with the thickness of the meat.

No radiant heat commercial size oven in the prior art, with unobstructed air movement between heating element and roasting meat, limits and concentrates the meat within a fixed horizontal heat stratum. In our preferred embodiment the 7.75 inch limitation on this stratum is an unheard of limitation. No prior art oven ever recognized the need, and therefore never set any fixed height limitation for horizontally-stacked heat strata within which meat is roasted. As explained in previous paragraphs, such fixed limitations are critically important for meat roasted within the narrow parameters of doneness levels prescribed for prime ribs. Thus, in combination with our other functional structures and fixed special limitations, the limitation on the height of our horizontal cooking heat stratum of 7.75 inches or less in this particular embodiment, helps prevent our meat from roasting outside of the 10° parameters for prime rib doneness levels.

For the successful achievement and maintenance of such a heat stratum in our preferred embodiment, we need the combined assistance of:

a. Means for using a meat thermometer.

Since our 1½ inch head room space leaves no room for the insertion of an upright meat thermometer, the Cradle cartons have made provision for a hole centered in the carton ends through which the tail ends of its meat films extend. A meat thermometer may be inserted into the meat through the hole in the tail end. This accommodation is shown in FIG. 5 where the stem 15*a* of thermometer 15 is lined up for insertion into the meat in carton 5*b* through the center hole 20 of tail end 12*b*. In FIGS. 9 and 10 thermometer 15 is shown fully inserted into the meat of carton 5*b*. Thus, the arrangement of our oven structures in cooperation with the structuring of the Cradle carton provides for a meat temperature reading almost precisely centered within the fixed horizontal cooking heat stratum of our oven. Our oven also obviously accommodates this centering of a thermometer within meat being roasted without using the Cradle carton.

b. Elimination of the mechanically-forced air convection.

To guarantee that the functional operation of our horizontally-fixed even-cooking heat stratum is not disturbed, we have made the negative provision of no mechanically-forced air convection in our oven. This is an absolute provision. Under no circumstances will mechanically-forced air convection be permitted in our oven. This is in direct opposition to practically all commercial prior art ovens, most of which have mechanically-forced air convection as an option. The reasons for this negative provision have been fully detailed in preceding paragraphs. The positive provision is air distribution limited to the movements and speeds under 440 cfm produced only by natural convection and stratification from low density wattage heating elements.

6. The Problem-Factor of High-Input Density.

The final functional problem-factor is the high-wattage heat input, or upsurges, during the switch-on time in all ovens. This problem is especially acute if the source of this input is located near the roasting meat.

In the prior art, rapid, excessive, and meat-harmful upsurges of heat input take place thirty to fifty times during a 5 hour roasting period. This is a normal phenomenon in prior art roasting ovens. The higher the heat input capability of the element is, the greater is the potential for an excessive harmful build-up of heat, and vice versa, the lower the heat input capability is, the lower is the actual potential for a harmful build-up. For example, a high-watt density element whose thermostat is set to roast at 350° may have an upsurge after the thermostat switches on of 100° over the 350° setting. This means that meat meant to roast at 350° may actually be roasting at 450° for at least 10% of the roasting time, i.e., during the switched-on time of the oven thermostat.

Since the preferred embodiment of our oven produces its best results when used with meat preparation systems such as that described in the Peters patents, which are designed to prevent internal meat-cell breakage, we designed our oven to prevent roasting over 212° F., the boiling point of water, at which temperature water expands into steam and meat cells begin rupturing.

As mentioned in previous paragraphs, a 10 watt output is the dividing line between low and high-watt densities. In selecting the wattage for our preferred oven we designed a heating element structured to deliver a wattage output slightly over the midway mark between zero and ten watts per square inch of element sheath surface. We selected the low density wattage of 5.5 watts per square inch. We selected this level of heat input because (1) it assists in holding our oven roasting temperature under 212°; (2) during the input cycle its upsurge is only about 25° over the thermostat setting. Thus, if it is desired to roast at 180°, the upsurge will only go to about 205° (180°+25°) in the distribution area of the element's heat input; (3) the 0.5 watts over the midway mark provides an upside and a zero downside tolerance as assurance against dropping below the midway mark in the low-density range.

As an added safety measure against over-heating areas of meat roasts adjacent to the heating element, we provide open space 26 in FIG. 10 of 4 inches in height in which to distribute and decrease our input heat before it reaches the meat on shelf 10*a*.

We thereby finally complete all the combined functional objectives whereby our overall functional objective is achieved.

7. The Problem-Factor of Commercial Practicability

One of the most surprising aspects of this invention is that, despite tailoring our oven's interior structure in strict obedience to known laws of physics, the final results also provide an oven that meets the following four ideal commercial requirements.

a. Speed in food preparation is a primary requirement in cooking for large numbers of people.

Among the reasons for speed is the need to avoid losses due to sudden change in the numbers of people to be fed. For restaurants this is a critical and constant problem. For example, Friday and Saturday nights are the big business nights of the week. If the weather is unfavorable, the customer count is low. If a heavy snow storm is a possibility for 5 p.m., a restaurant may have few or no customers. If the weather is favorable, a restaurant must be prepared with food for a full house.

With food entrees like steaks that can be prepared within a few minutes, the vagaries of the weather present no problem. But with beef roasts that require many hours to prepare, the weather presents a severe problem. For example, an oven-full of boneless 10 lb. ribeyes to be finished medium-rare will require about 10 hours roasting time if roasted constantly at 145°. That means roasts scheduled for a 5 p.m. finish time must be placed in the oven at 7 a.m. At 7 a.m. the National Weather Service's 10 hour prediction for 5 p.m. may still be uncertain. However, by noontime, a 5 hour prediction for 5 p.m. becomes quite accurate. Thus, by noontime a restaurant can make a relatively risk-free decision on how much food to prepare.

By giving recognition to known physical facts on the distribution of heat in an aqueous medium, we were able to reduce the element of risk for restaurants cooking prime ribs, and still remain within the doneness level heat parameters for prime ribs. For example, it is well known in physics that water is (1) a relatively fast conductor of heat, and (2) the addition of heat will thus be distributed uniformly practically instantly throughout water in a 4 to 5 inch deep pan even though the source of heat input may be a burner operating at 750° at the bottom of the pan holding the water.

Since the protein area of beef is largely an aqueous medium, averaging about 75% water, it is possible to roast a 10 lb., 5 inch thick boneless beef rib-eye in 5 hours at 180° instead of 10 hours at 145° and finish at the medium-rare level of 145° throughout by reducing the oven temperature to 145° as soon as the center reaches 145°. The effect of this natural phenomenon on our oven specifications was to increase our operating heat limit close to, but still under 212°, thus alleviating the danger of going over this steam-producing and cell-rupturing level, and still give the restaurant a viable opportunity to reduce the cooking hours for prime ribs to a practical time period of about 5 hours. To effectuate this opportunity and safeguard its limits, we provide our exemplary oven with a thermostat that will produce the necessary limitations on the temperatures and times. It must be understood that the 212° limitation is subject to some variations due to the usual inaccuracies of thermostat metal and/or gaseous components, and the different atmospheric pressures at sea level.

b. Simplicity in operation is another desirable commercial objective.

Because of our careful adherence to known laws of physics to determine the space, elevational, and heat limitations outlined above, we have sharply reduced and limited the operational options provided in most commercial prior art ovens. This correspondingly reduces the number of complications that now take place in prior art ovens. For example, in prior art ovens:

(1) The range of cooking temperatures goes to an unfixed limit of 500° or more; in our oven this range is reduced by about 60% to an operational top limit averaging just under 212°;

(2) The choices of shelf-elevation levels ranges from 2 to 12; in our oven there is only one shelf; there is no choice;

(3) Optional forced-air convection speeds are practically unlimited; our oven has no options. We have no forced air. We are limited to natural convection only;

(4) Locations of roasting meat may be changed to any one of a plural number and elevational distances from the source of heat; in our oven meat can be located only at one fixed distance from the source of heat;

(5) Meat can, and does, roast within heat strata whose parameters considerably exceed the 10° temperature parameters required for the doneness levels of prime ribs; our oven temperatures stay within these 10° parameters;

(6) Meat is located at varying elevational levels from the thermostat sensor; in our oven it is always at one fixed level closely adjacent to, and directly over, the sensor;

(7) There is a wide range of heat-input densities, usually spanning the entire range of both high and low watt oven element densities; our oven is limited to low-watt element densities only.

By eliminating and/or reducing optional operational functions that are not desirable, and by incorporating and/or limiting operational functions in our oven to only those that are necessary for our desired finished meat results, we achieve a fixed operational simplicity not found in prior art ovens.

c. The achievement of superior results from a processing appliance always provides a competitive advantage in the commercial market. Superior results in beef roast cookery are measured in terms of juice retention and uniform and even levels of doneness throughout each roast individually and all collectively. The combination of cooperating functional structures in our oven necessary to achieve such superior results have been fully detailed in preceding paragraphs.

d. Lower capital cost is a basic advantage over competition in achieving a high level of commercial success. It is a truism in the market place that the lower the cost is of any item, the more commercially acceptable and successful it will be. The best evidence of such a lower capital cost is a direct comparison with the price of the largest selling prior art oven sold specifically as a prime rib oven. Its lowest price model that will accomodate six rib-eyes packed in Cradle Cartons sells for $1200.00. Our comparable capacity single-cavity oven is priced at $650.00, or approximately 45% less than the competition's lowest priced prior art oven.

Although we have described in detail the cooperating combination of structures, functions, and limitations of our exemplary oven, it will be understood that these details may be varied without departing from the spirit and scope of our invention.

We claim:

1. A radiant heat oven for cooking three or more meat roasts within a single cavity, the oven including a heat sensor positioned within the oven cavity, for controlling a low power density heating element a single shelf mounted within the oven cavity between the sensor and the top of the oven cavity so that meat roasts supported by the shelf are approximately midway between the sensor and the top of the oven cavity, the distance between the bottom and the top of the oven cavity being about 11 inches, said shelf being located about 6½ inches from said top of the oven cavity, said heat sensor being located underneath said shelf at a distance of about 1¼ inches from said shelf, the distance between said sensor to the top of the oven cavity being about 7¾ inches, and said low power density heating element having a wattage emission of 10 watts or less per square inch of element surface located adjacent to, and spread substantially across, the bottom of said oven cavity at a distance from said shelf of about 4 inches.

2. The structure of claim 1 in which said heating element is slidably supported within the oven and can be manually pulled out of the oven cavity.

3. A radiant-heat oven for roasting three or more meat roasts within a cavity of the oven at roasting temperatures under 212°, and subjected to natural convection ambient air movements of speeds not exceeding 440 cfm, the oven including a single shelf which holds meat roasts, a heating element below said shelf, and a temperature sensor for controlling said heating element between said shelf and said heating element, said shelf supporting said roasts on a common horizontal plane so that the middle of the thicknesses of said roasts are positioned approximately midway between said temperature sensor and the top of said oven cavity.

4. A radiant-heat meat roasting oven having an oven cavity, a thermostat sensor mounted within the oven cavity for controlling a lower power density heating element, a single fixed-elevational open-grill shelf supporting a plurality of meat roasts thereon all at the same horizontal level so that the thickness centers of said roasts are approximately midway between said thermostat sensor and the top of said cavity, and the low power density heating element having a wattage emission of 10 watts or less per square inch of element surface mounted at the bottom of said oven cavity at a distance of about 4 inches below said meat, and having a horizontal-plane-configuration that extends substantially throughout the plane beneath the shelf.

5. The structure of claim 4 in which said heating element includes relatively straight portions which are substantially aligned with spaces between adjacent meat roasts.

* * * * *